US005779361A

United States Patent [19]

Sugiura

[11] Patent Number: 5,779,361

[45] Date of Patent: Jul. 14, 1998

[54] STATIC MIXER

[75] Inventor: Hikoroku Sugiura, Funabashi, Japan

[73] Assignee: Shinyou Technologies, Inc., Chiba-ken, Japan

[21] Appl. No.: 854,580

[22] Filed: May 12, 1997

[30] Foreign Application Priority Data

May 14, 1996 [JP] Japan ..... 8-143514

[51] Int. Cl.[6] ..... B01F 13/00

[52] U.S. Cl. ..... 366/340; 366/336; 138/42

[58] Field of Search ..... 366/336, 337, 366/338, 339, 340; 138/40, 42, 44

[56] References Cited

U.S. PATENT DOCUMENTS

| | | | |
|---|---|---|---|
| 3,582,365 | 6/1971 | Lindsey | 366/340 |
| 4,085,462 | 4/1978 | Booy | 366/340 |
| 4,712,921 | 12/1987 | Sugiura | 366/336 |
| 5,156,458 | 10/1992 | Hemrajani et al. | 366/336 |
| 5,232,383 | 8/1993 | Goebel et al. | 366/340 |
| 5,535,175 | 7/1996 | Niimi | 366/336 |

FOREIGN PATENT DOCUMENTS

| | | | |
|---|---|---|---|
| 459267 | 2/1975 | U.S.S.R. | 366/340 |

*Primary Examiner*—Tony G. Soohoo
*Attorney, Agent, or Firm*—Bachman & LaPointe, P.C.

[57] ABSTRACT

There is provided a new static mixer with a low pressure loss and a high agitating/mixing efficiency. The mixer comprises in the midst of a fluid passage a mixing body having a larger diameter than the fluid passage. The mixing body has a mixing body cylinder portion, an inlet hollow portion having an inlet port fitted to the cylinder portion, and a outlet hollow portion having an outlet port. An impingement cylinder having an diameter larger than a diameter of the outlet port is disposed within the mixing body such that its opening is positioned in a confronting relation with the inlet port. A plurality of recesses are provided at at least one of an inner side portion of bottom of the impingement cylinder, an inner surface portion of the hollow inlet port, an inner surface portion of the hollow outlet port, an inner circumferential portion of a cylindrical portion of the impingement cylinder, and an inner circumferential surface portion of the cylindrical portion of the mixing body.

5 Claims, 6 Drawing Sheets

STATIC MIXER

BACKGROUND OF THE INVENTION

1. Field of the Invention

The present invention relates to a static mixer which is interposed in the midst of a flow passage for fluids for the purpose of agitating and mixing the fluids.

As an apparatus for agitating and mixing fluids such as liquid, air and mobile solid as particles, static mixers are widely used for general purposes. The static mixer, different from the generally known system in which agitating wings are rotated in the fluids, has no agitating element or similarly movable elements, but is disposed in the midst of the stream of the fluids and has a system for producing a centrifugal flow such as a turbulent flow in the fluid flow stream to thereby agitate and mix the fluids, wherein the energy for the agitation/mixing is obtained from the fluids.

2. Description of the Prior Art

A typical system of the static mixer as described above has a twisting plate or plates in the fluid passage so that a revolving or spiral flow is generated in the downstream of the fluids to agitate and mix the fluids.

The known static mixer of the type as described above has some serious problems of low efficiency of agitating/mixing and that it must be provided in multi-stage construction so as to overcome the low efficiency in he agitating and mixing. Consequently, a pressure loss becomes inevitably large and, therefore, a larger power is needed for the flow of the fluids.

In other words, the know static mixer having a twisting plate produces a revolving or spiral flow in the downstream of the fluids so that the fluids are agitator and mixed but, on the other hand, the revolving or spiral flow generated by the twisted plate has a small agitating power. In addition, the revolving or spiral flow has a general tendencies that it has a lower pressure at the center thereof and a higher pressure at the outer circumferential portion and that a centrifugal force is produced by the revolving flow and, therefore, the substances in the fluids are not agitated or mixed but on the other hand separated in specific gravity by the distribution of the pressure in the fluids and the centrifugal force. For example, the inventors of the present invention have conducted an experiment that water and air were mixed by the known static mixer which employs the twisting plate and found that a large part of the air is gathered in the form of relatively large bubbles along a central axis of the flowing passage. This apparently means that the water and air were not agitated or mixed sufficiently.

The revolving or spiral flow, which is generated at the downstream of the twisting plate and gradually and naturally reduced as it is flown downstream is maintained in a relatively long distance of the stream. Thus, in the known static mixer of the type described above, not only the twisting plate but also the revolving or spiral flow itself serve as a resistance to the flow of the fluids and, accordingly, a pressure loss becomes larger as a whole. In the experiment of the water and air described above, a pressure loss of 0.1 to 0.15 $Kg/cm^2$ at the flow rate of 1 to 2 m/sec was found. In order to obtain a sufficient agitation/mixing, it was found that a combination of a plurality of the known static mixer in a 4 to 12-stage construction is needed, with the result of a pressure loss of 0.4 to 1.8 $Kg/cm^2$.

SUMMARY OF THE INVENTION

An object of the invention is to provide an improvement in the static mixer.

Another object of the present invention is to provide a new static mixer which provides less pressure loss and higher agitating/mixing efficiency.

According to a first aspect of the present invention there is provided a static mixer comprising:

a mixing body concentrically disposed in the midst of a fluid flow passage, the mixing body having a larger diameter than a diameter of the fluid flow passage, the mixing body having a cylindrical portion, a hollow inlet port fixed to a first end of the cylindrical portion, and a hollow outlet port fixed to a second end of the cylindrical portion, an impingement cylinder disposed within the mixing body and having a diameter larger than a diameter of the hollow inlet port and smaller than an inner diameter of an inner diameter of the cylindrical portion of the mixing body, the impingement cylinder having an opening in a confronting spaced relation with the hollow inlet port, a fixing wing plate means extending radially outwardly from an outer circumferential surface of the impingement cylinder and having an extended end connected to an inner circumferential surface of the cylindrical portion of the mixing body for concentrically holding the impingement cylinder, and a plurality of recesses formed at at lest one of an inner side portion of bottom of the impingement cylinder, an inner surface portion of the hollow inlet port, an inner surface portion of the hollow outlet port, an inner circumferential portion of a cylindrical portion of the impingement cylinder, and an inner circumferential surface portion of the cylindrical portion of the mixing body.

In the construction described above, the fluids introduced into the mixing body from the inlet port are directed to the impingement cylinder and then abutted or impinged against the bottom of the impingement cylinder. By this abutment of the fluids, the direction of the fluids is reversed to form turbulent flow which results in generation of a large centrifugal flow at the position adjacent to the bottom of the impingement cylinder.

When the fluids are introduced into the mixing body from the inlet port, the fluid flow which has been reduced in pressure and abutted against the bottom of the impingement cylinder and changed its flowing direction is then returned to the previous state thereof because the mixing body has a larger diameter than the diameter of the fluid passage and, consequently, the pressure loss which is essentially large in the fluid impingement is decreased. Further, by this structure, the fluids coming into the inlet port are in abutment with the reversely flowing fluids so that the both fluids are violently agitated and mixed together.

In addition to the above, in the structure of the static mixer of the first aspect of the invention described above, since a plurality of recesses are formed at at least one of an inner side portion of bottom of the impingement cylinder, an inner surface portion of the hollow inlet port, an inner surface portion of the hollow outlet port, an inner circumferential portion of a cylindrical portion of the impingement cylinder, and an inner circumferential surface portion of the cylindrical portion of the mixing body, the fluids are impinged against the above-described elements to generate a number of relatively small turbulent flows at each of the recesses to establish agitating and mixing (differential agitation), and as a whole, relatively large turbulent flows are generated to establish agitation and mixing (integral agitation), so that the fluid flow is made turbulent more complicated to thereby improve the agitating/mixing efficiency.

In a second aspect of the present invention, there is provided a static mixer comprising:

a mixing body concentrically disposed in the midst of a fluid flow passage, the mixing body having a larger diameter than a diameter of the fluid flow passage, the mixing body having a cylindrical portion, a hollow inlet port fixed to a first end of the cylindrical portion, and a hollow outlet port fixed to a second end of the cylindrical portion, an impingement cylinder disposed within the mixing body and having a diameter larger than a diameter of the hollow inlet port and smaller than an inner diameter of an inner diameter of the cylindrical portion of the mixing body, the impingement cylinder having an opening in a confronting spaced relation with the hollow inlet port, a sectional diameter of the fluid flow portion between the opening of the impingement cylinder and the inlet port being set to be larger than a sectional diameter of the fluid flow passage, a fixing wing plate means extending radially outwardly from an outer circumferential surface of the impingement cylinder and having an extended end connected to an inner circumferential surface of the cylindrical portion of the mixing body for concentrically holding the impingement cylinder, and a plurality of recesses formed at at least one of an inner side portion of bottom of the impingement cylinder, an inner surface portion of the hollow inlet port, an inner surface portion of the hollow outlet port, an inner circumferential portion of a cylindrical portion of the impingement cylinder, and an inner circumferential surface portion of the cylindrical portion of the mixing body.

In the second aspect of the invention described above, a sectional diameter of the fluid flow portion between the opening of the impingement cylinder and the hollow inlet port is set to be larger than a sectional diameter of the fluid flow passage. Therefore, no constriction of a fluid flow is generated at the portions between the opening of the impingement cylinder and the hollow inlet port, and a pressure reduction is reliably generated at the portion adjacent to the inlet port by means of the orifice.

In a third aspect of the present invention, there is provided a static mixer comprising:

a mixing body concentrically disposed in the midst of a fluid flow passage, the mixing body having a larger diameter than a diameter of the fluid flow passage, the mixing body having a cylindrical portion, a hollow inlet port fixed to a first end of the cylindrical portion, and a hollow outlet port fixed to a second end of the cylindrical portion, an impingement cylinder disposed within the mixing body and having a diameter larger than a diameter of the hollow inlet port and smaller than an inner diameter of an inner diameter of the cylindrical portion of the mixing body, the impingement cylinder having an opening in a confronting spaced relation with the hollow inlet port, a sectional diameter of the fluid flow portion between the opening of the impingement cylinder and the inlet port being set to be larger than a sectional diameter of the fluid flow passage, a fixing wing late means extending radially outwardly from an outer circumferential surface of the impingement cylinder and twisted at a predetermined angle towards an axial direction of the impingement cylinder, and the fixing wing plate means having an extended end connected to an inner circumferential surface of the cylindrical portion of the mixing body for concentrically holding the impingement cylinder, and a plurality of recesses formed at at least one of an inner side portion of bottom of the impingement cylinder, an outer surface portion of the hollow inlet port, an inner surface portion of the hollow outlet port, an inner circumferential portion of a cylindrical portion of the impingement cylinder, and an inner circumferential surface portion of the cylindrical portion of the mixing body.

In the third aspect of the invention in which the fixing wing plate means is twisted, the fluids passing through this portion is made to an entirely larger revolving flow, and the flowing direction is changed to provide a further agitating and mixing effects.

In a fourth aspect of the present invention, there is provided a static mixer comprising:

a mixing body concentrically disposed in the midst of a fluid flow passage, the mixing body having a larger diameter than a diameter of the fluid flow passage, the mixing body having a cylindrical portion, a hollow inlet port fixed to a first end of the cylindrical portion, an inlet tubular portion connected to the inlet port, and a hollow outlet port fixed to a second end of the cylindrical portion, a spiral ribbon on an inner surface of the inlet tubular portion, an impingement cylinder disposed within the mixing body and having a diameter larger than a diameter of the hollow inlet port and smaller than an inner diameter of an inner diameter of the cylindrical portion of the mixing body, the impingement cylinder having an opening in a confronting spaced relation with the hollow inlet port, a sectional diameter of the fluid flow portion between the opening of the impingement cylinder and the inlet port being set to be larger than a sectional diameter of the fluid flow passage, fixing wing plate means extending radially outwardly from an outer circumferential surface of the impingement cylinder and having an extended end connected to an inner circumferential surface of the cylindrical portion of the mixing body for concentrically holding the impingement cylinder so that an outer circumferential end of the impingement cylinder is concentrically fixed and housed within the mixing body, and a plurality of recesses formed at at least one of an inner side portion of bottom of the impingement cylinder, an inner surface portion of the hollow inlet port, an inner surface portion of the hollow outlet port, an inner circumferential portion of a cylindrical portion of the impingement cylinder, and an inner circumferential surface portion of the cylindrical portion of the mixing body.

In the fourth aspect of the invention, the twisted ribbon permits the fluids in the inlet tubular portion to be revolved to abut against the bottom surface of the impingement cylinder. Thus more complex turbulent flows are produced so that the agitating and mixing efficiency is improved.

In the third and fourth aspects of the invention, revolving flow is generated which is then abutted against the portions of the outlet port at the downstream of the flow and consequently the generated revolving flow is substantially diminished. Thus, a pressure loss is not increased unfavorably, whereas in the conventional known structure revolving flows are present along a long distance of the fluid flow.

In a fifth aspect of the invention, there is provided a static mixer comprising:

a mixing body concentrically disposed in the midst of a fluid flow passage, the mixing body having a larger diameter than a diameter of the fluid flow passage, the mixing body having a cylindrical portion, a hollow inlet port fixed to a first end of the cylindrical portion, an inlet tubular portion connected to the inlet port, and a hollow outlet port fixed to a second end of the cylindrical portion, an impingement cylinder disposed within the mixing body and having a diameter larger than a diameter of the hollow inlet port and smaller than an inner diameter of an inner diameter of the cylindrical portion of the mixing body, impingement cylinder having an opening in a confronting spaced relation with the hollow inlet port, a sectional diameter of the fluid flow portion between the opening of the impingement cylinder and the inlet port being set to be larger than a sectional diameter of the fluid flow passage, an outlet tubular portion or a downstream fluid passage being confrontingly extended for a predetermined distance into the mixing body, on an inner surface of the outlet port, a fixing wing plate means extending radially outwardly from an outer circumferential surface of the impingement cylinder and having an extended end connected to an inner circumferential surface of the cylindrical portion of the mixing body for concentrically holding the impingement cylinder so that an outer circumferential end of the impingement cylinder is concentrically fixed and housed within the mixing body, and a plurality of recesses formed at at least one of an inner side portion of bottom of the impingement cylinder, an inner surface portion of the hollow inlet port, an inner surface portion of the hollow outlet port, an inner circumferential portion of a cylindrical portion of the impingement cylinder, and an inner circumferential surface portion of the cylindrical portion of the mixing body.

In the fifth aspect of the invention described above, when the fluid flows out of the outlet port, it must flow over the end of the flow passage of downstream which is extended into the mixing body and, therefore, the flowing direction is changed at this point, so that an additional agitating and mixing are effected.

DESCRIPTION OF THE PREFERRED EMBODIMENT

Figure 1:
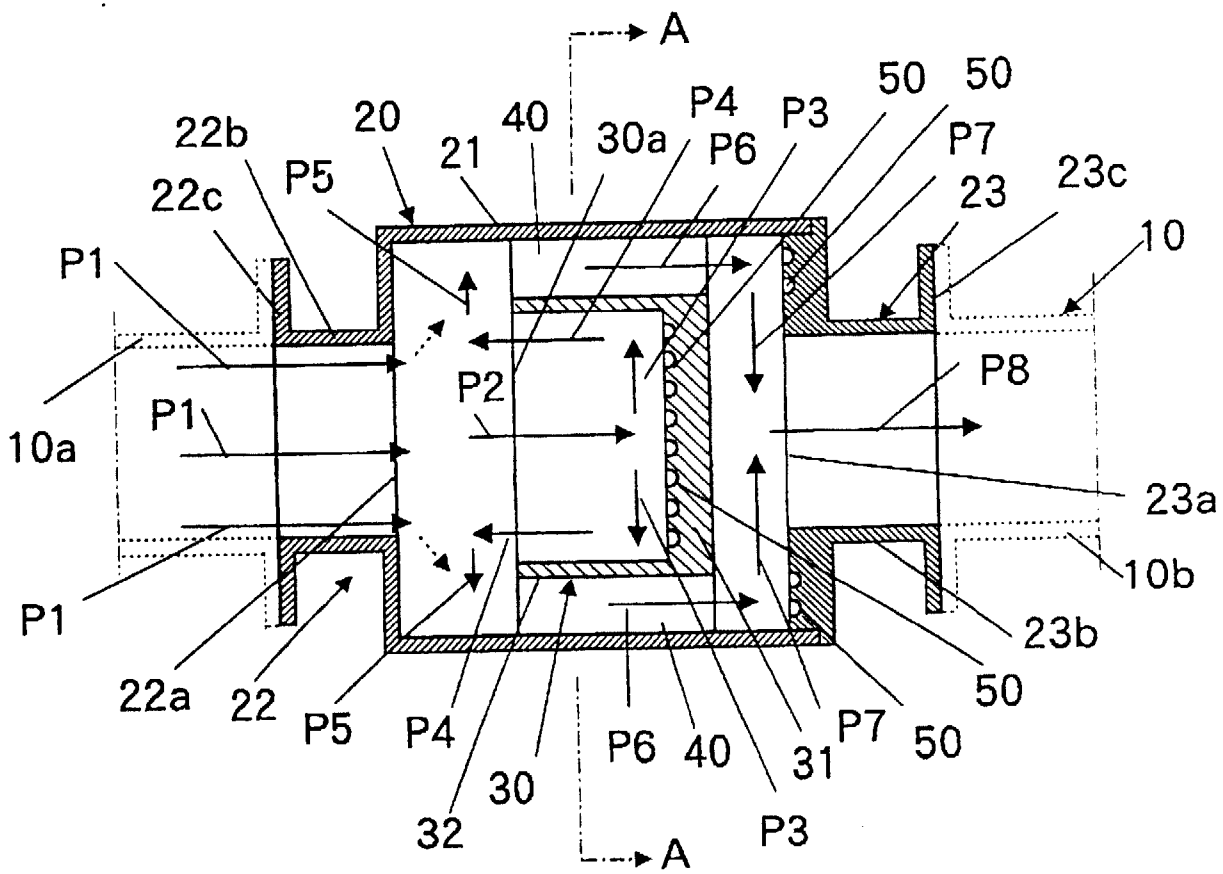
FIG. 1 is a longitudinal sectional view of a static mixer in a first embodiment of the present invention.

Preferred embodiments of the invention will be described with reference to the accompanying drawings.

A mixing body 20 is concentrically disposed in the mixing of a fluid flow passage 10. The term "fluid(s)" and its derivatives intend to mean liquids, air and mobile particles and solids or their mixtures and the wordings "fluid flow passage" tends to mean a flow passage of these fluids, which flow from one position to the other.

The fluid flow passage 10 has an upstream fluid passage 10*a* and a downstream fluid passage 10*b*, and the mixing body 20 is interposed between the two passages 10*a* and 10*b*. The mixing body 20 has a mixing body cylinder portion 21, an inlet hollow port 22 which is adapted to an end of the mixing body cylinder portion 21 and having an inlet 22*a*, and an outlet hollow port 23 having an outlet 23*a*.

In the illustrated embodiment, an inlet tubular portion 22*b* is extended outwardly from the inlet 22*a*, and a flange portion 22*c* is connected to an extended end of the inlet tubular portion 22*a*. Similarly, an outlet tubular portion 23*b* is extended outwardly from the outlet 23*a*, and a flange portion 23*c* is connected to an extended end of the outlet tubular portion 23*b*.

A downstream end of the upstream fluid passage 10*a* is connected to the flange 22*c*, and an upstream end of the downstream fluid passage 10*b* is connected to the other flange 23*c* so that the mixing body 20 itself forms a part of the fluid passage 10 and that the fluid flows from the upstream fluid passage 10*a* to the downstream fluid passage 10*b* through the mixing body 20.

An impingement (or collision) cylinder 30 which has a diameter larger than a diameter of the inlet 22*a* and smaller than an inner diameter of the mixing body cylinder portion 21 is concentrically fixed within the mixing body 20, with its opening 30*a* being in a confronting relation with the inlet 22*a*, by means of a fixing wing plates 40, 40, . . . which extends radially outwardly from the outer circumference of the impingement cylinder 30 so that an extended end thereof is connected to an inner circumference of the mixing body cylinder portion 21.

In the illustrated embodiments of the present invention, all the fluid passage 10, the inlet tubular portion 22*b* and the outlet tubular portion 23*b* are designed to be of the same diameter and, therefore, the wordings "diameter larger than the inlet 22*a*" is identical to the wordings "diameter larger than a diameter of the fluid passage 10". Although not illustrated, however, a downstream portion of the inlet tubular portion 22*b* can be made smaller in diameter than the fluid passage 10 to form a nozzle-like portion, and this structure is included in the concept of the invention. In other words, in case that a diameter of the downstream potion of the inlet tubular portion 22b is decreased, a diameter of the inlet 22a becomes less than a diameter of the fluid passage 10 and, therefore, the reduced-diameter portion may possibly be larger in diameter than a diameter of the inlet 22a even though the reduced-diameter portion is less in diameter than the fluid passage 10, and this structure also is included in the concept of the present invention.

The impingement cylinder 30 has a bottom wall to form a U-shape in cross section as illustrated, and its cylinder portion 32 is fundamentally of the same diameter along its length, but modified structures in which the opening portion 30a is somewhat increased or otherwise reduced in diameter can be employed. If the opening portion 30a of reduced diameter is used, an agitation efficiency can be improved to result in an in crease of the pressure loss and, on the other hand, if the opening portion of increased diameter is used, the pressure loss can be reduced with a small decrease of the agitation efficiency.

Accordingly, the inlet 22a and the opening 30a of the impingement cylinder 30 is in a spaced confronting relation with each other, and a fluid illustrated by an arrow P1 at the inlet 22a is substantially flown into the impingement cylinder 30 as shown by an arrow P2. Then, the fluid is moved toward the circumferential wall of the impingement cylinder 30 as shown by an arrow P3 and then overflown out of the impingement cylinder 30 as shown by an arrow P4. After that, the overflown fluid abuts against and collide with the other fluid coming into from the inlet 22a. In other words, the fluid flow of the P1 direction is in collision with the fluid flow of the P4 direction. In this case, since the impingement cylinder 30 is formed to have a larger diameter than the diameter of the inlet 22a, the fluid in the impingement cylinder 30 flows towards the bottom 31 (i.e., in the P1 direction) at the axial position of the impingement cylinder 30 whereas the fluid at the circumferential position flows toward the opening 30a (i.e. in the P4 direction).

The fluid overflown out of the impingement cylinder 30 moves towards the outer circumference thereof as shown by an arrow P5 and further to the downstream position through a space between the impingement cylinder 30 and the mixing body 21 as shown by an arrow P6. Then, the fluid collides with the outlet port 21 to change its flowing direction to the central portion as shown by an arrow P7, with the result that the fluids from every direction indicated by the arrows P7, P7 . . . are collided with each other to move out of the outlet 23a as shown by an arrow P8. When the fluid changes its flowing direction to form an adverse flow in the diametrically opposite direction, it is matter of course that an extremely large agitation force is generated and, at the same time, it brings about a very large pressure loss as a result. Therefore, the static mixer which employs the impingement plate as described above was not placed into a practical application. However, in the present invention, the mixing body 20 has a larger diameter than the diameter of the fluid passage 10 (inlet 22a) and, therefore, the pressure of the fluid passage adjacent to the downstream port of the inlet 22a is decreased by an orifice effect, and the pressure-reduction area of the fluid stream changes the flowing direction of the fluid to form the adverse flow so that the pressure reduction is diminished.

A plurality of recesses 50, 50, . . . 50 are formed at lease one of the inner portion of the bottom 31 of the impingement cylinder 30, the inner portion of the inlet port 22, the inner portion of the outlet port 23, inner circumferential portion of the cylindrical portion 32 of the impingement cylinder 30, and the inner circumferential portion of the mixing body 21.

Figure 2:
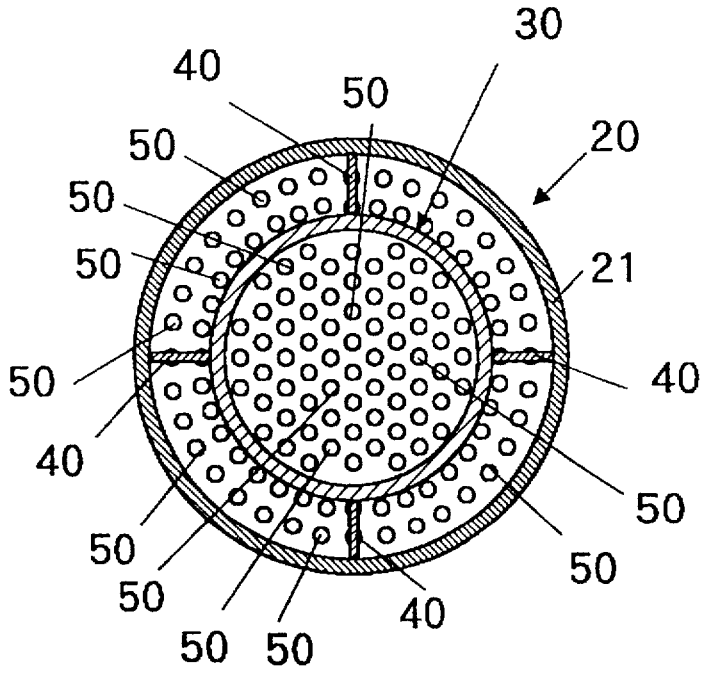
FIG. 2 is a sectional view taken along line A—A of FIG. 1 of the drawing.

In the embodiment of FIGS. 1 and 2, the recesses 50 are formed on the inner portion of the bottom 31 of the impingement cylinder 30 and the inner portion of the outlet port 23, and in these two portions there occur the most violent collisions. Thus, provision of a number of the recesses 50 at these portions will result in generation of a number of centrifugal flows (differential agitation) to provide much more fined agitation/mixing, and this minute centrifugal flow rides on an entirely larger reversal flow to provide a strong agitation effect (integral agitation).

Figure 3:
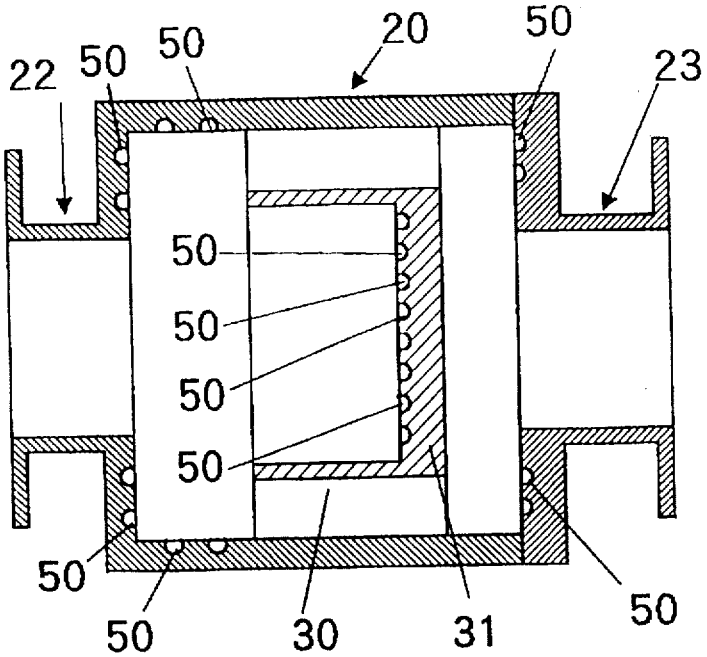
FIG. 3 is a longitudinal sectional view of a static mixer in a further embodiment of the present invention.

In the embodiment of FIG. 3, the recesses 50 are formed on the inner portion of the bottom 31 of the impingement cylinder 30, the inner portion of the inlet port 22, the inner portion of the outlet port 23, and the inner circumferential portion of the mixing body 21. Since the fluids in the portion of the inner circumferential portion of the cylinder 21 of the mixing body collide in substantially right angles at the upstream side only, the recesses 50 are provided at only the upstream portion of the inner circumferential portion of the cylinder portion 32.

Figure 4:
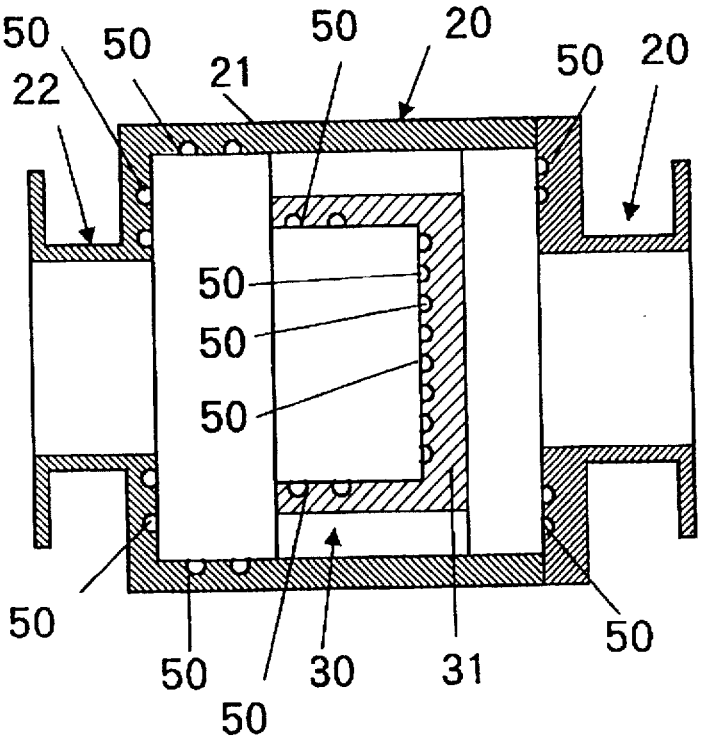
FIG. 4 is a longitudinal sectional view of a static mixer in another embodiment of the present invention.
Figure 5:
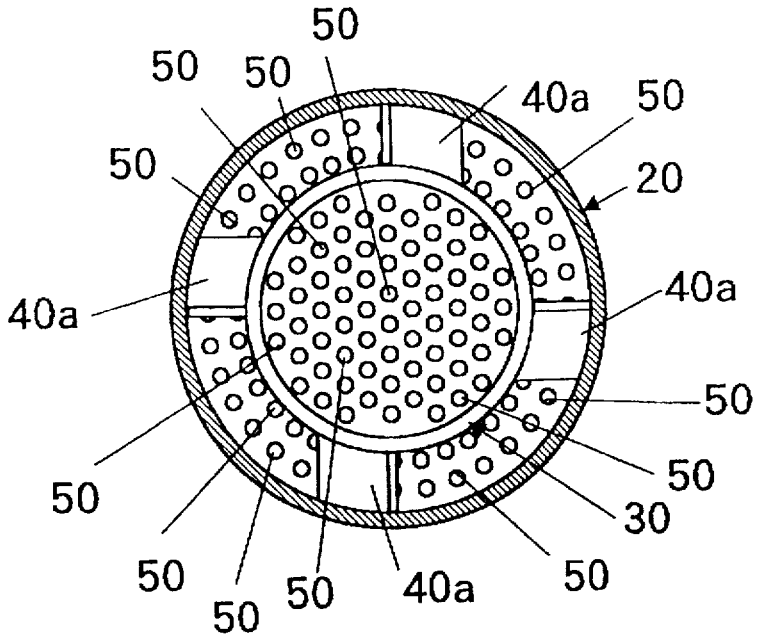
FIG. 5 is a sectional view taken along line A—A in FIG. 1, showing another embodiment of the invention.

In the embodiment of FIG. 4, the recesses 50 are formed at the inner portion of the bottom 31 of the impingement cylinder 30, the inner portion of the inlet port 22, the inner portion of the outlet port 23, inner circumferential portion of the cylindrical portion 32 of the impingement cylinder 30, and the inner circumferential portion of the mixing body 21. At the inner circumferential portion of the cylinder portion 32, there is few portions at which the fluids are in a collision of a right angle, and only limited turbulent flows are collided. Thus, the recesses 50 are provided at the upstream side of the inner circumferential portion of the cylinder portion 32 and no other places.

Figure 9:
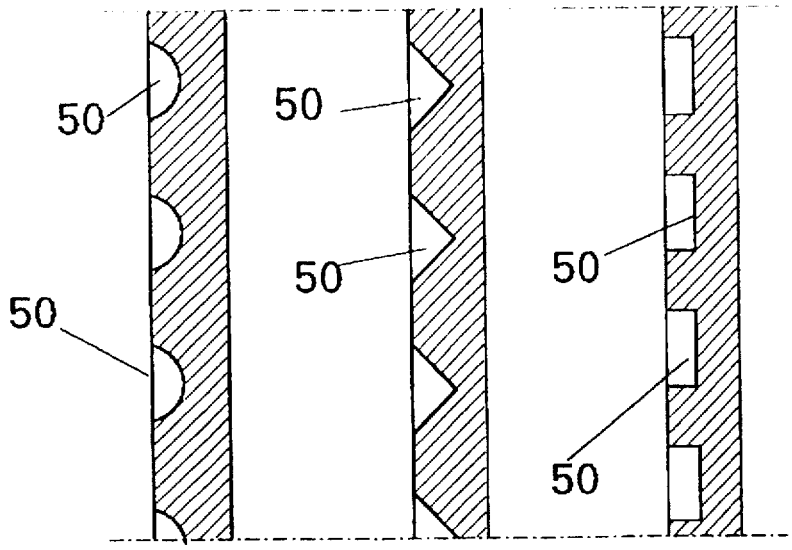
FIG. 9 is a sectional view of some types of recesses employable for the mixer of the present invention.

The recesses 50 described above, which may have desired shapes in both plane and sectional aspect, are generally semi-spherical, but the shape of the recesses can be selected as desired as illustrated, for example, in FIG. 9. Though not illustrated, a plan view shape of the recesses can be selected as desired.

The present invention of the second aspect will be explained. The second aspect of the present invention is similar with the first aspect of the invention, that is, the structure of the static mixer which comprises:

- a mixing body 20 concentrically disposed in the midst of a fluid flow passage 10,
- the mixing body 20 having a larger diameter than a diameter of the fluid flow passage 10,
- the mixing body 20 having a cylindrical portion 21, a hollow inlet port 22 fixed to a first end of the cylindrical portion 21, and a hollow outlet port 23 fixed to a second end of the cylindrical portion 21,
- an impingement cylinder 30 disposed within the mixing body 21 and having a diameter larger than a diameter of the hollow inlet port 22 and smaller than an inner diameter of an inner diameter of the cylindrical portion 21 of the mixing body 20, the impingement cylinder 30 having an opening 30a in a confronting spaced relation with the hollow inlet port 22,
- a fixing wing plate means 40 extending radially outwardly from an outer circumferential surface of the impingement cylinder 30 and having an extended end connected to an inner circumferential surface of the cylindrical portion 21 of the mixing body 20 for concentrically holding the impingement cylinder 30, and
- a plurality of recesses 50 formed at at least one of an inner side portion of bottom 31 of the impingement cylinder 30, an inner surface portion of the hollow inlet port 22, an inner surface portion of the hollow outlet port 23, an inner circumferential portion of a cylindrical portion 32 of the impingement cylinder 30, and an inner circumferential surface portion of the cylindrical portion 21 of the mixing body.

The feature in the second aspect of the invention different from the first aspect of the invention is that a sectional diameter of the fluid flow portion between the opening of the impingement cylinder and the hollow inlet port is et to be larger than a sectional diameter of the fluid flow passage.

In other words, the fluid coming into the mixing body 21 from the inlet 22*a* is introduced into the impingement cylinder 30 and then flown adversely through a space between an end of the opening 30*a* of the impingement cylinder 30 and the inlet port 22, and thereafter advanced through a space between the outer circumference of the impingement cylinder 30 and the inner circumference of the cylinder portion 21 of the mixing body 20. Therefore, if there is a constricted or narrower portion adjacent to the inlet 22*a* than the fluid passage 10, the pressure reduction which was effected adjacent to the inlet 22*a* by the orifice effect as described above is not sufficiently effected. Thus, as constricted or narrower portion is formed at the portion distal to and away from the inlet 22*a* so that an orifice effect is sufficiently exhibited at the portion adjacent to the inlet 22*a*.

In the feature of the second aspect of the invention, a sectional area of the flow passage between the end of the opening 30*a* and the inlet port 22 is larger than a sectional area of the flow passage 10, and more preferably a sectional area of the flow passage between the outer circumference of the impingement cylinder 30 and the inner circumference of the mixing body 21 is set to be larger than a sectional are of the fluid passage 10. Here, the wordings "larger than the sectional area of the fluid passage 10" intends to mean that it is larger than the inlet 22*a* when the downstream portion of the inlet cylinder 22*b* is narrowed or constricted.

The positions where the numbers of recesses 50 are disposed are similar with those in the feature of the first aspect of the invention described above.

In the third aspect of the invention, the fixing wing plates 40 in the second aspect of the invention are replaced by the twisted fixing wing plates 40*a* which are extended radially outwardly from the outer circumference of the impingement cylinder 30 and twisted at a predetermined angle in the axial direction of the impingement cylinder 30, and the outer ends of which are connected with the inner circumference of the mixing body 21.

In other words, the twisted fixing wing plates 40*a* are disposed to provide a revolving flow to the fluids so that more constant agitation and mixing are established, and this revolving flow described above is located within the mixing body cylinder 21 which, therefore, different from the revolving flow in the conventional mixer.

Figure 6:
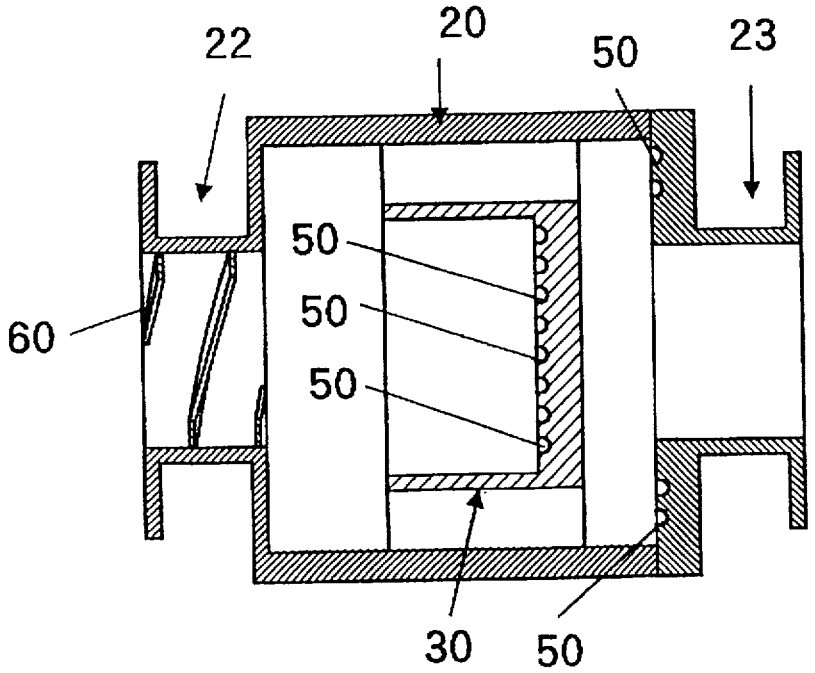
FIG. 6 is a longitudinal sectional view of a static mixer showing a further embodiment of the invention.
Figure 7:
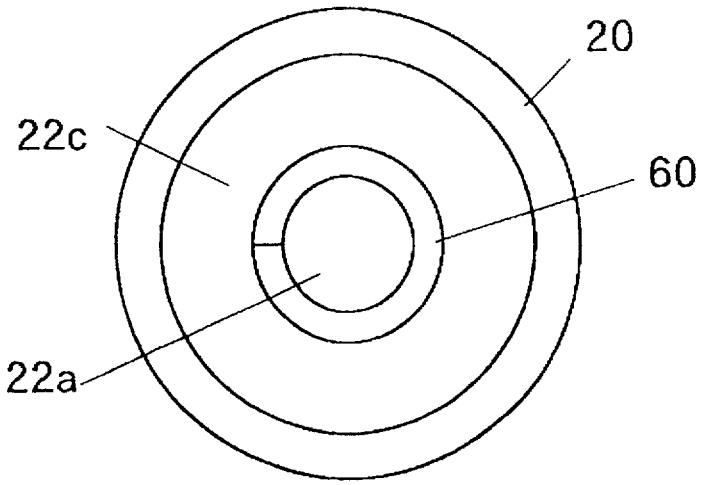
FIG. 7 is a left-side view of the mixer in the embodiment of FIG. 6.

With respect to the invention of the fourth aspect described above, the spiral ribbon 60, in addition to the structure of the second aspect, is disposed on the inner circumference of the inlet cylinder portion 22*b* connected to the inlet 22*a*. The spiral ribbon 60 can be provided by fitting a belt-like member of a predetermined width in a spiral form in the axial direction on the inner circumferential surface of the inlet cylinder portion 22*b*, as illustrated in FIG. 6. In case that the fluid passage 10 is directly coupled to the inlet 22*a*, the spiral ribbon 60 can be fitted within the fluid passage 10. Thus, the fluid advances from the inlet cylinder portion 22*b* (from the inlet 22*a*) in the form of a revolving stream so that similar significant effects and advantages as those of the third aspect of the invention described above.

In the fifth aspect of the invention, either the outlet cylinder portion 23*b* or the downstream fluid passage 10*b* is disposed in addition to the structure of the second aspect of the invention, for a certain distance, within the mixing body 21 at the side of the outlet 23*a*.

In this structure that the outlet cylinder 23*b* is extended for a predetermined distance into the cylinder of the mixing body 21, the fluid must flow over the extended portion of the outlet cylinder 23*b* and, therefore, the flow direction is further changed to effect the improvement in mixing efficiency.

Figure 8:
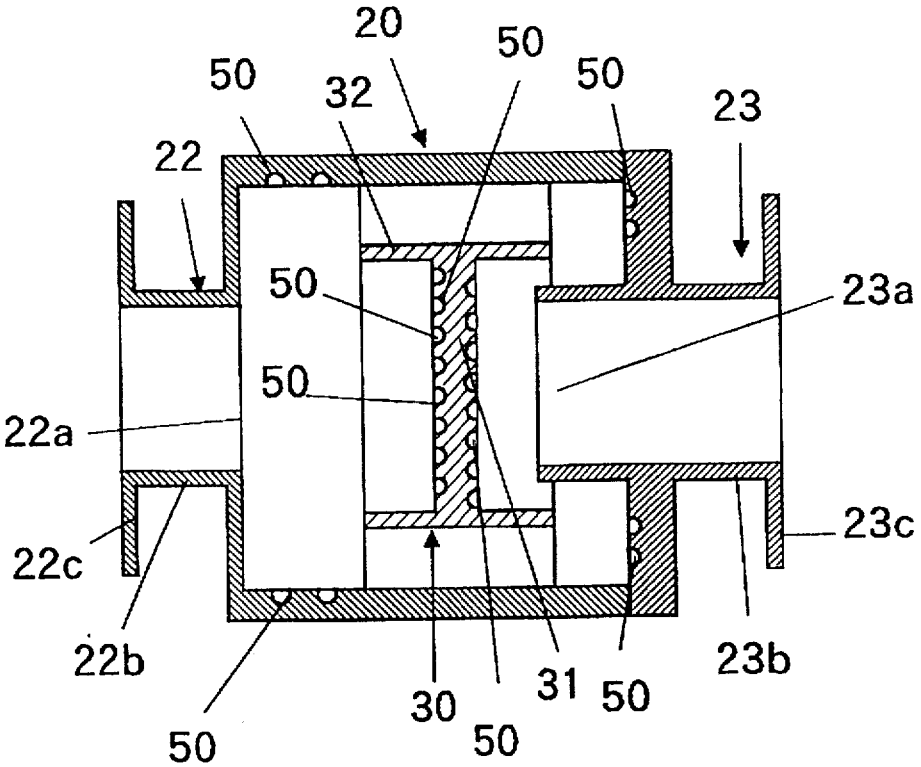
FIG. 8 is a longitudinal sectional view of a static mixer in a further embodiment of the invention.

In the embodiment of FIG. 8, the impingement cylinder 30 is opened at its ends of both the upstream and downstream sides, with its central portion being partitioned by means of the bottom portion 31, and an end of the outlet cylinder 23*b* being extended into the opening of the downstream of the impingement cylinder 30, so that an entire flow of the fluid can pass through the complexed passages.

According to the present invention, the pressure loss can be decreased with higher efficiencies of agitation and mixing. In the experiments by using the water, the pressure loss is extremely low as 0.1 to 0.15 $Kg/cm^2$ at 1 to 2 m/sec, which is not so significantly low as the pressure loss obtained by the conventional mixer with the twisted plate, but only a single mixer of the present invention can provide the sufficient agitating/mixing operations. Therefore, the pressure loss of the present invention is correspondent with a value of from one-fourth (¼) to one-twelfth (1/12) of the conventional mixer.

In the present invention, different agitating/mixing methods are combined and, therefore, an efficient agitating/mixing can be established. More specifically, there are provided a flow passage changing method in which fluid flow directions are changed in a complex way, an impingement method in which a fluid is collided with a fixed member such as a bottom portion 21, another impingement method in which fluids of different directions are collided with each other, and a convolute method in which small convolutes or whirlpools are formed by the recesses 50 are combined, with the result that extremely efficient agitating/mixing effect can be expected.

Further, by the construction that the mixing body 20 is designed to have a diameter larger than the diameter of the fluid passage 10 so that an orifice effect is generated, the pressure within the mixing body 20 is decreased to reduce a pressure loss at the time of agitation. Further, since the agitation is conducted within a limited short passage of the fluid within the mixing body 20, the turbulent flow does not provide any effect of increasing a pressure loss in a long stream of the fluid, a desired static mixer with a high agitating/mixing efficiency but with a less pressure loss.

In the structure of the second aspect of the invention, a sectional area of the fluid flow passage between the end of the opening 30*a* of the impingement cylinder 30 and the inlet hollow port 22 is set to be larger than the sectional area of the fluid passage 10 and, therefore, the pressure loss region by the orifice effect within the mixing body 20 is effectively limited within the entire area of the interior of the mixing body with the result of a high efficiency and a low pressure loss.

In the structure of the third and fourth aspects of the invention which use a revolving flow, more efficient agitating/mixing can be expected. This revolving flow is substantially decreased at the time of flowing out of the outlet port 23*a* which is reduced in diameter than that of the mixing body 20 and, therefore, it does not cause a pressure loss at the downstream.

In the fifth aspect of the invention in which the outlet cylinder portion 23b is disposed, for a predetermined distance, within the mixing body 21 at the inner surface of the outlet port 23a, a further effective agitating/mixing can be conducted when the fluid flows over the portion which is located within the mixing body 21.

Although the present invention has been described with reference to the preferred embodiments thereof, many modifications and alterations can be made within the spirit of the invention.

What is claimed is:

1. A static mixer comprising:

a mixing body concentrically disposed in the midst of a fluid flow passage, said mixing body having a larger diameter than a diameter of said fluid flow passage, said mixing body having a cylindrical portion, a hollow inlet port fixed to a first end of said cylindrical portion, and a hollow outlet port fixed to a second end of said cylindrical portion, an impingement cylinder disposed within said mixing body and having a diameter larger than a diameter of said hollow inlet port and smaller than an inner diameter of an inner diameter of said cylindrical portion of the mixing body, said impingement cylinder having an opening in a confronting spaced relation with said hollow inlet port, a fixing wing plate means extending radially outwardly from an outer circumferential surface of said impingement cylinder and having an extended end connected to an inner circumferential surface of said cylindrical portion of the mixing body for concentrically holding said impingement cylinder, and a plurality of recesses formed at at least one of an inner side portion of bottom of said impingement cylinder, an inner surface portion of said hollow inlet port, an inner surface portion of said hollow outlet port, an inner circumferential portion of a cylindrical portion of said impingement cylinder, and an inner circumferential surface portion of said cylindrical portion of said mixing body.

2. A static mixer comprising:

a mixing body concentrically disposed in the midst of a fluid flow passage, said mixing body having a larger diameter than a diameter of said fluid flow passage, said mixing body having a cylindrical portion, a hollow inlet port fixed to a first end of said cylindrical portion, and a hollow outlet port fixed to a second end of said cylindrical portion, an impingement cylinder disposed within said mixing body and having a diameter larger than a diameter of said hollow inlet port and smaller than an inner diameter of an inner diameter of said cylindrical portion of the mixing body, said impingement cylinder having an opening in a confronting spaced relation with said hollow inlet port, a sectional diameter of the fluid flow portion between said opening of said impingement cylinder and said inlet port being set to be larger than a sectional diameter of the fluid flow passage, a fixing wing plate means extending radially outwardly from an outer circumferential surface of said impingement cylinder and having an extended end connected to an inner circumferential surface of said cylindrical portion of the mixing body for concentrically holding said impingement cylinder, and a plurality of recesses formed at at least one of an inner side portion of bottom of said impingement cylinder, an inner surface portion of said hollow inlet port, an inner surface portion of said hollow outlet port, an inner circumferential portion of a cylindrical portion of said impingement cylinder, and an inner circumferential surface portion of said cylindrical portion of said mixing body.

3. A static mixer comprising:

a mixing body concentrically disposed in the midst of a fluid flow passage, said mixing body having a larger diameter than a diameter of said fluid flow passage, said mixing body having a cylindrical portion, a hollow inlet port fixed to a first end of said cylindrical portion, and a hollow outlet port fixed to a second end of said cylindrical portion, an impingement cylinder disposed within said mixing body and having a diameter larger than a diameter of said hollow inlet port and smaller than an inner diameter of an inner diameter of said cylindrical portion of the mixing body, said impingement cylinder having an opening in a confronting spaced relation with said hollow inlet port, a sectional diameter of the fluid flow portion between said opening of said impingement cylinder and said inlet port being set to be larger than a sectional diameter of the fluid flow passage, a fixing wing plate means extending radially outwardly from an outer circumferential surface of said impingement cylinder and twisted at a predetermined angle towards an axial direction of said impingement cylinder, and said fixing wing plate means having an extended end connected to an inner circumferential surface of said cylindrical portion of the mixing body for concentrically holding said impingement cylinder, and a plurality of recesses formed at at least one of an inner side portion of bottom of said impingement cylinder, an inner surface portion of said hollow inlet port, an inner surface portion of said hollow outlet port, an inner circumferential portion of a cylindrical portion of said impingement cylinder, and an inner circumferential surface portion of said cylindrical portion of said mixing body.

4. A static mixer comprising:

a mixing body concentrically disposed in the midst of a fluid flow passage, said mixing body having a larger diameter than a diameter of said fluid flow passage, said mixing body having a cylindrical portion, a hollow inlet port fixed to a first end of said cylindrical portion, an inlet tubular portion connected to said inlet port, and a hollow outlet port fixed to a second end of said cylindrical portion, a spiral ribbon on an inner surface of said inlet tubular portion, an impingement cylinder disposed within said mixing body and having a diameter larger than a diameter of said hollow inlet port and smaller than an inner diameter of an inner diameter of said cylindrical portion of the mixing body, said impingement cylinder having an opening in a confronting spaced relation with said hollow inlet port, a sectional diameter of the fluid flow portion between said opening of said impingement cylinder and said inlet port being set to be larger than a sectional diameter of the fluid flow passage, a fixing wing plate means extending radially outwardly from an outer circumferential surface of said impingement cylinder and having an extended end connected to an inner circumferential surface of said cylindrical portion of the mixing body for concentrically holding said impingement cylinder so that an outer circumferential end of said impingement cylinder is concentrically fixed and housed within said mixing body, and a plurality of recesses formed at at least one of an inner side portion of bottom of said impingement cylinder, an inner surface portion of said hollow inlet port, an inner surface portion of said hollow outlet port, an inner circumferential portion of a cylindrical portion of said impingement cylinder, and an inner circumferential surface portion of said cylindrical portion of said mixing body.

5. A static mixer comprising:

a mixing body concentrically disposed in the midst of a fluid flow passage, said mixing body having a larger diameter than a diameter of said fluid flow passage, said mixing body having a cylindrical portion, a hollow inlet port fixed to a first end of said cylindrical portion, an inlet tubular portion connected to said inlet port, and a hollow outlet port fixed to a second end of said cylindrical portion, an impingement cylinder disposed within said mixing body and having a diameter larger than a diameter of said hollow inlet port and smaller than an inner diameter of an inner diameter of said cylindrical portion of the mixing body, said impingement cylinder having an opening in a confronting spaced relation with said hollow inlet port, a sectional diameter of the fluid flow portion between said opening of said impingement cylinder and said inlet port being set to be larger than a sectional diameter of the fluid flow passage, an outlet tubular portion or a downstream fluid passage being confrontingly extended for a predetermined distance into said mixing body, on an inner surface of said outlet port, a fixing wing plate means extending radially outwardly from an outer circumferential surface of said impingement cylinder and having an extended end connected to an inner circumferential surface of said cylindrical portion of the mixing body for concentrically holding said impingement cylinder so that an outer circumferential end of said impingement cylinder is concentrically fixed and housed within said mixing body, and a plurality of recesses formed at at least one of an inner side portion of bottom of said impingement cylinder, an inner surface portion of said hollow inlet port, an inner surface portion of said hollow outlet port, an inner circumferential portion of a cylindrical portion of said impingement cylinder, and an inner circumferential surface portion of said cylindrical portion of said mixing body.

* * * * *